US005682659A

United States Patent [19]

Chang

[11] Patent Number: 5,682,659

[45] Date of Patent: Nov. 4, 1997

[54] HAND BLIND RIVETER

[76] Inventor: Ching-Tsung Chang, No. 3, Yih Fan Lane, Chan She Li, Nan Tun Dist., Taichung, Taiwan

[21] Appl. No.: 689,717

[22] Filed: Aug. 16, 1996

[51] Int. Cl.[6] ..... B21J 15/20

[52] U.S. Cl. ..... 29/243.523; 72/453.17

[58] Field of Search ..... 29/243.521, 243.523, 29/243.524, 243.525; 72/453.17

[56] References Cited

U.S. PATENT DOCUMENTS 3,713,321 1/1973 La Pointe ..... 29/243.524

4,086,802 5/1978 Ewig, Jr. ..... 29/243.524

4,263,801 4/1981 Gregory ..... 29/243.524

5,425,164 6/1995 El Dessouky ..... 29/243.534

*Primary Examiner*—David Jones

*Attorney, Agent, or Firm*—Bacon & Thomas

[57] ABSTRACT

A hand blind riveter having an oil-pressure actuator to change an improve the originally labor-consuming operation thereof to an effort-saving and highly efficient operation by transmitting working power through oil pressure produced by the oil-pressure actuator.

1 Claim, 5 Drawing Sheets

HAND BLIND RIVETER

BACKGROUND OF THE INVENTION

FIGS. 1 and 2 illustrate a conventional hand blind riveter which mainly includes a slidable blind rivet holder 1 pivotally connected to a working end of a handle 2. When the handle 2 is depressed at the other operating end, a leverage provided near the working end thereof permits the slidable blind rivet holder 1 to be pulled to move away from workpieces 4 to be riveted together, forcing a front head 31 of a blind rivet 3 held by the slidable blind rivet holder 1 to retract into a rivet seat 32 and thereby rivet the workpieces 4 together. Riveting workpieces 4 together by means of the conventional hand blind riveter requires an operator to exert considerable strength. The operator shall become worn out after operating the riveter several times.

SUMMARY OF THE INVENTION

It is therefore a primary object of the present invention to provide an improved hand blind riveter which can be operated in an effort-saving manner by incorporating an oil-pressure means in the riveter.

The improved hand blind riveter according to the present invention is characterized in an oil-pressure means mounted between a handle and a slidable blind rivet holder of the hand blind riveter. The oil-pressure means includes a first piston connected to the handle and a second piston connected to the slidable blind rivet holder. Whereby, when the handle is depressed, the first piston connected thereto is caused to actuate the oil-pressure means to function like a pump, so that the slidable blind rivet holder can be easily driven to move through the second piston under the oil pressure provided by the oil-pressure means.

DETAILED DESCRIPTION OF THE PREFERRED EMBODIMENT

Figure 1:
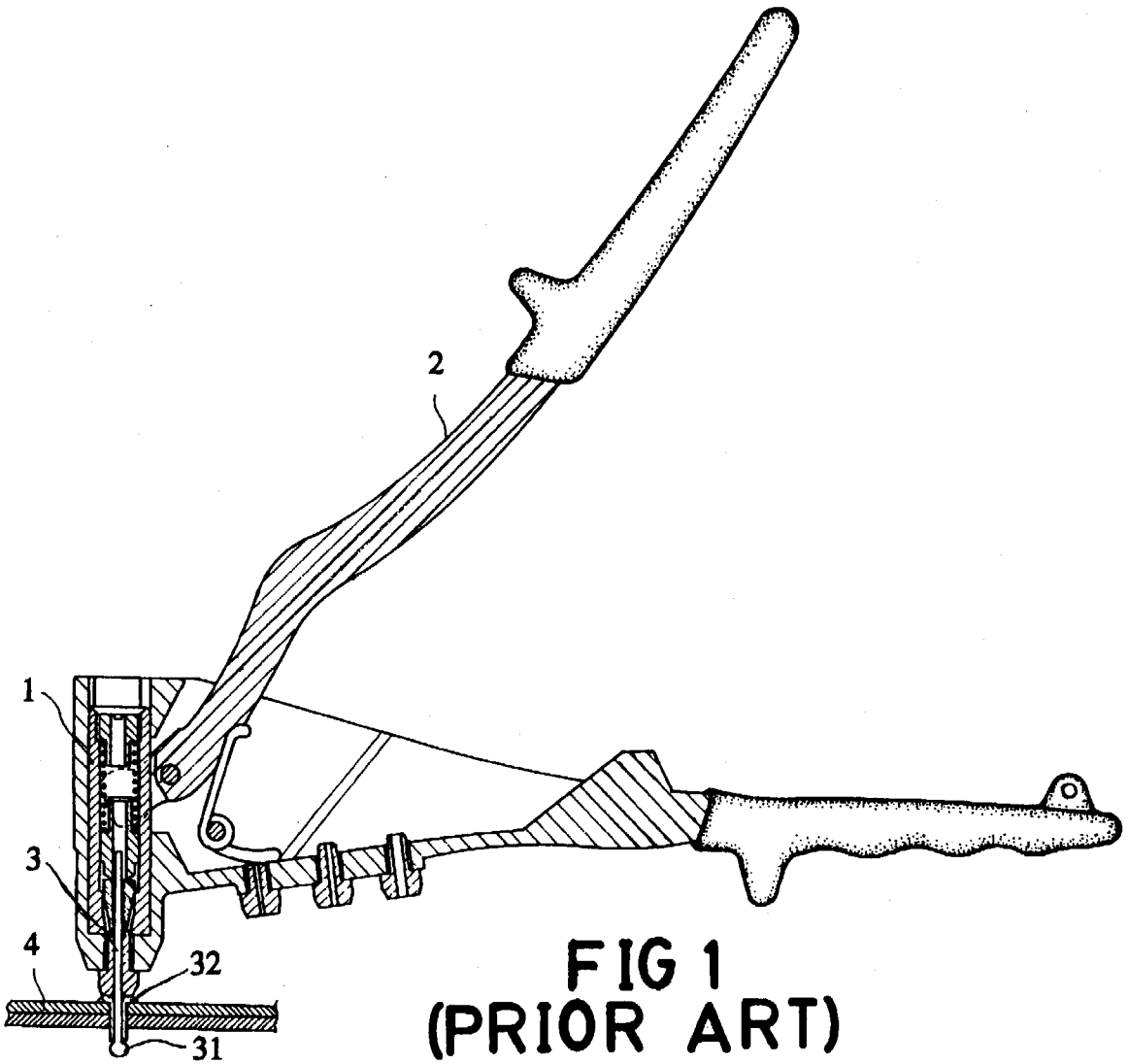
FIG 1 (PRIOR ART)
FIG. 1 is a partially sectional view of a conventional hand blind riveter of which the handle and the slidable blind rivet holder are in a standby position.
Figure 2:
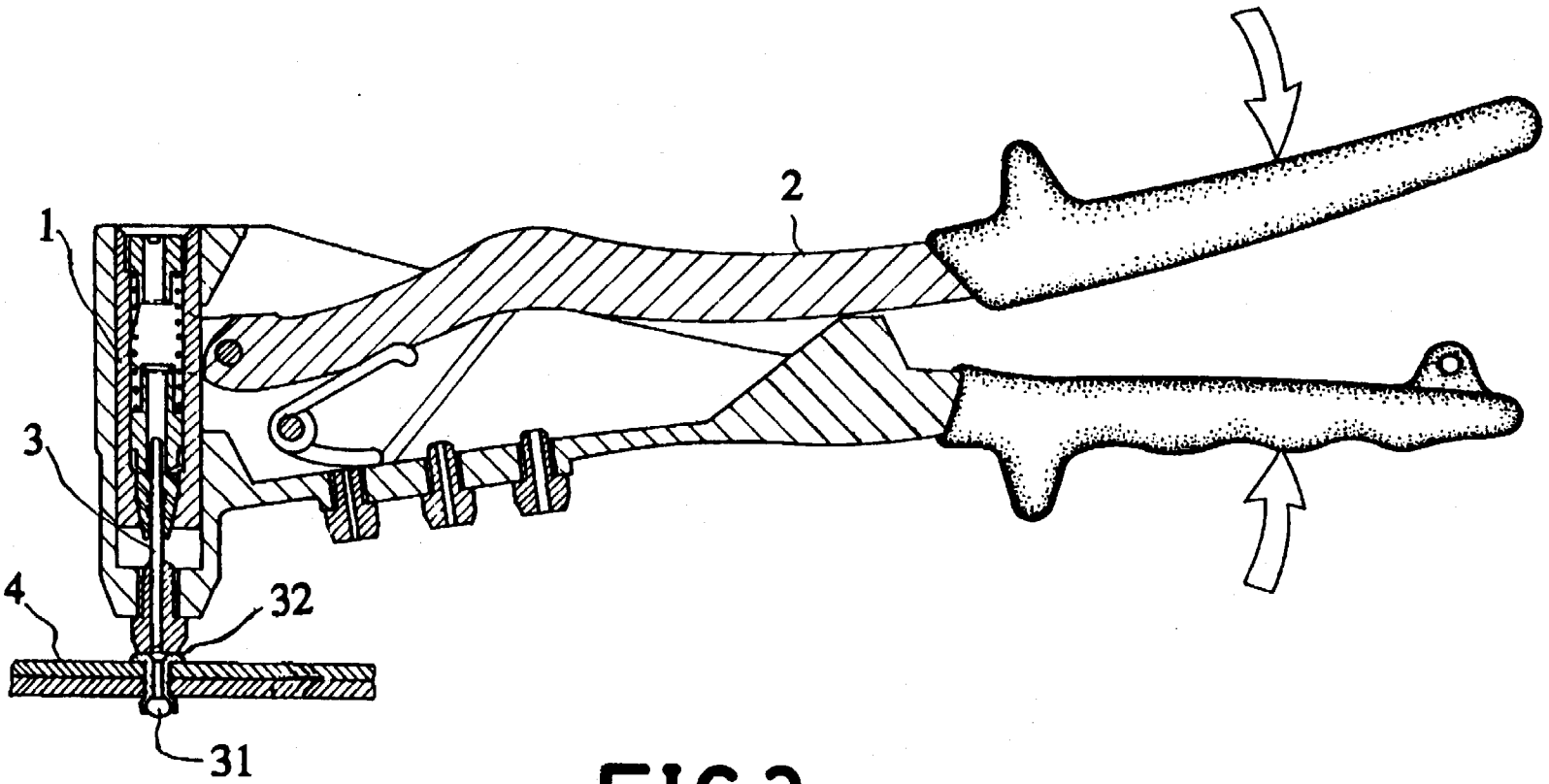
FIG 2 (PRIOR ART)
FIG. 2 is similar to FIG. 1 but with the handle depressed and the slidable blind rivet holder pulled backward to complete the riveting.
Figure 3:
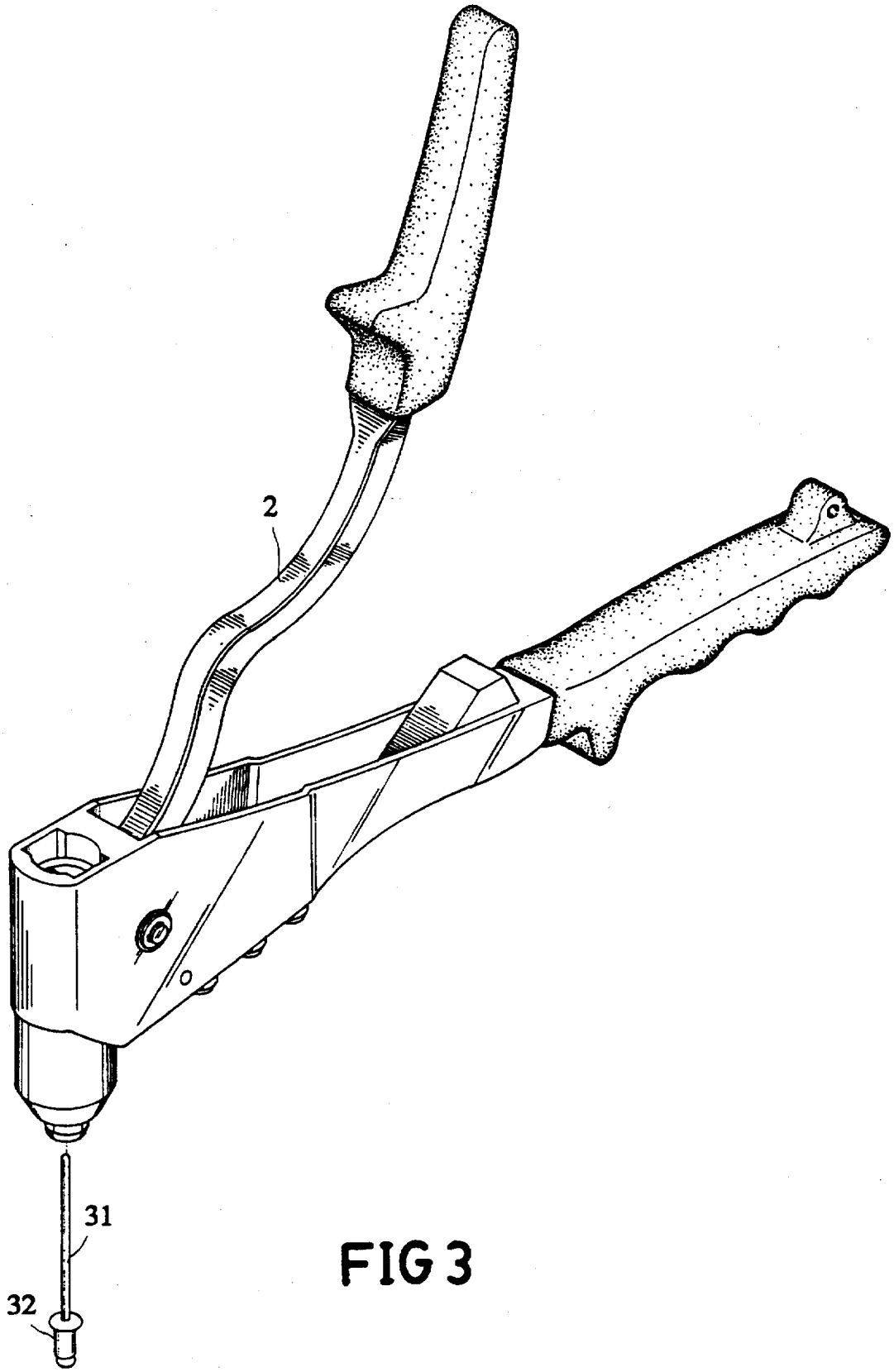
FIG. 3 is a perspective view showing the appearance of the hand blind riveter according to the present invention.
Figure 4:
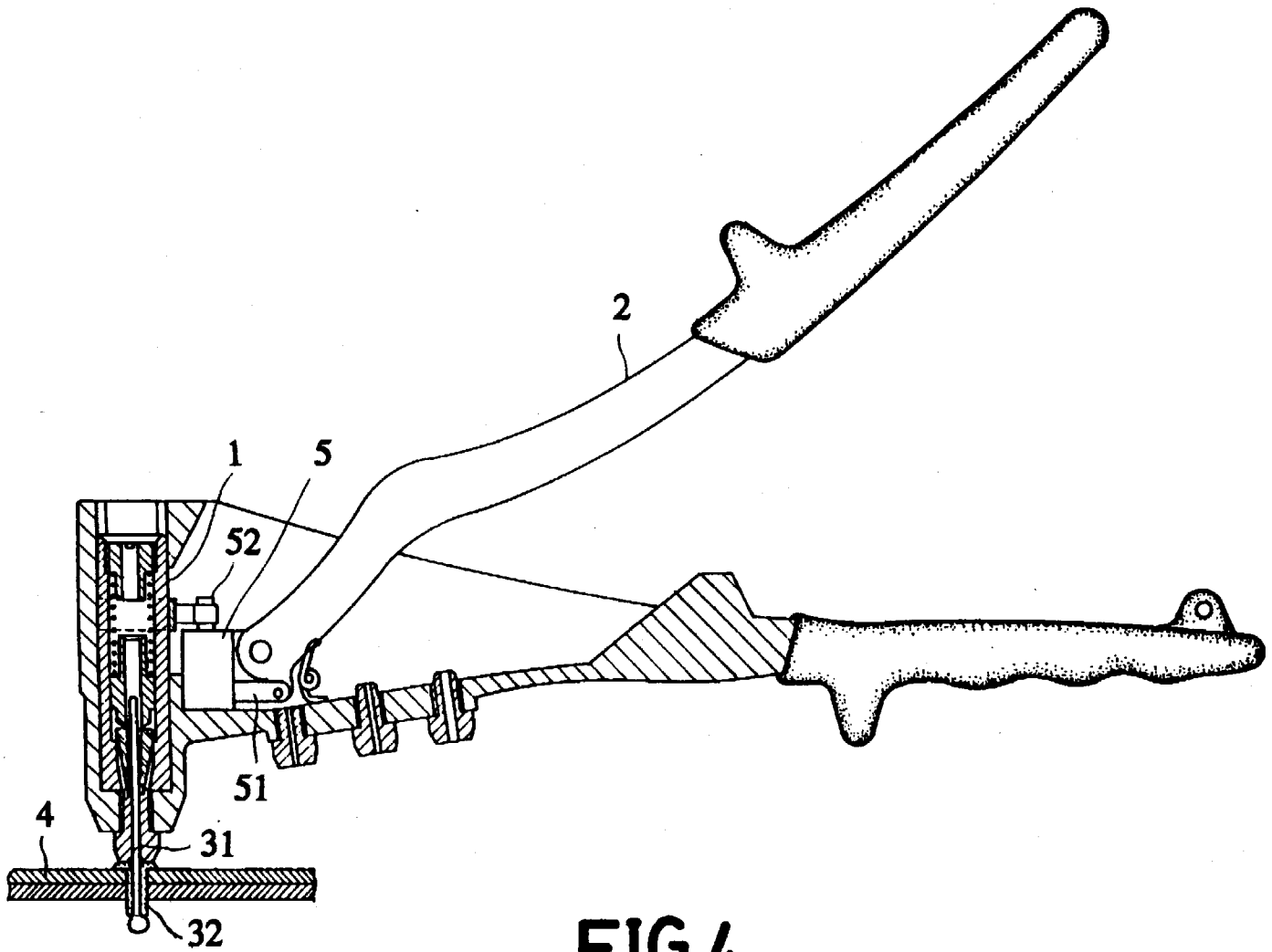
FIG. 4 is a partially sectional view of the hand blind riveter of the present invention showing the structure thereof.

Please refer to FIGS. 3 and 4. The present invention relates to a hand blind riveter mainly includes a slidable blind rivet holder 1, a handle 2, and an oil-pressure means 5 mounted between a working end of the handle 2 and the slidable blind rivet holder 1.

Figure 5:
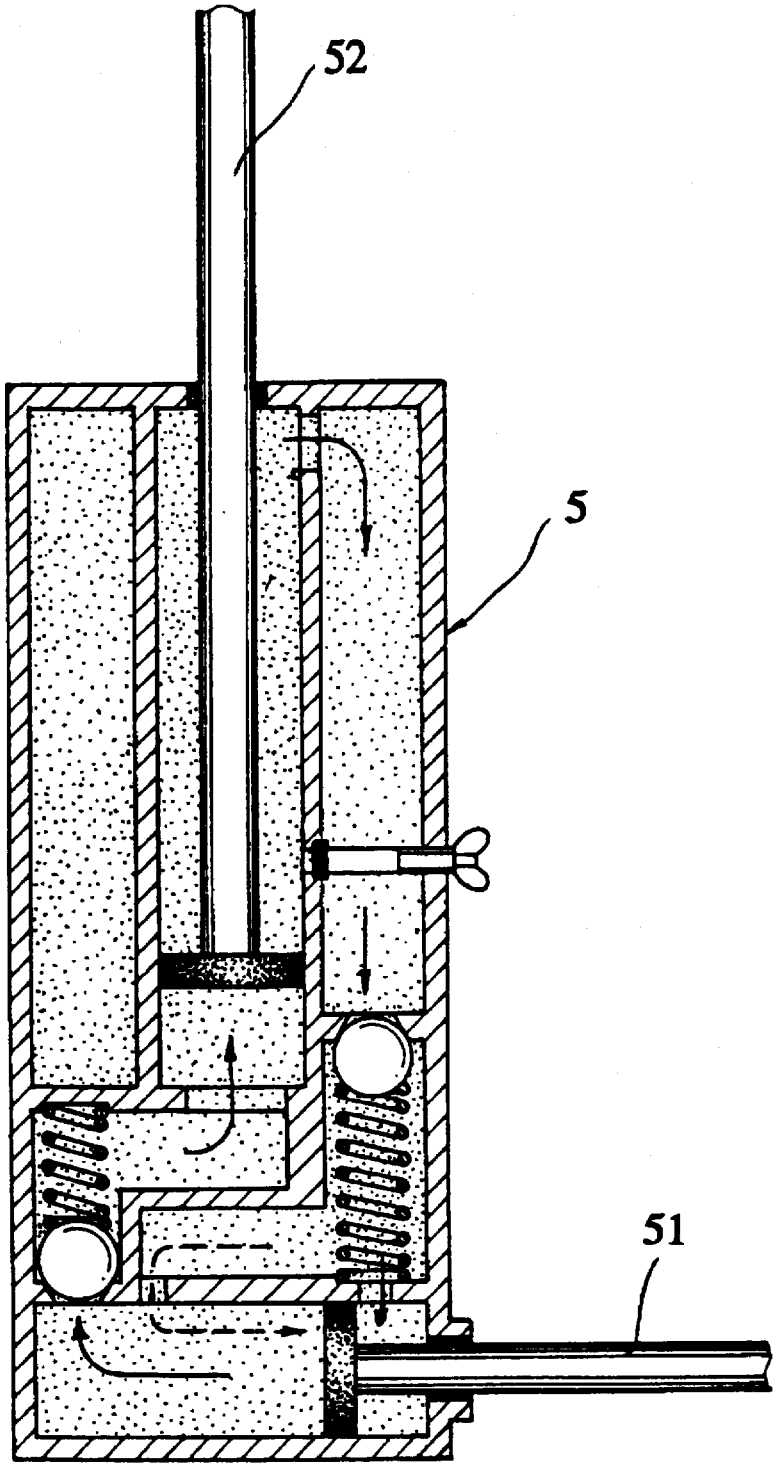
FIG. 5 is an enlarged, fragmentary, sectional view showing the oil-pressure means of the present invention.

Please further refer to FIG. 5 for the detailed structure of the oil-pressure means 5. The oil-pressure means 5 mainly includes basic oil passages, valves, and a first and a second pistons 51 and 52. The first piston 51 is pivotally connected at an outer end to the working end of the handle 2 and can be pushed forward by depressing an operating end opposite to the working end of the handle 2. The second piston 52 is connected at an outer end to the slidable blind rivet holder 1. When the handle 2 is depressed at the operating end thereof, the first piston 51 connected to the working end of the handle 2 is pushed inward to produce a pressure inside the oil-pressure means 5. The produced pressure is transmitted via the oil inside the oil-pressure means 5 to push the second piston 52 to move outward. The outward moving piston 52 further pull the slidable blind rivet holder 1 to move backward, pulling the blind rivet 3 backward to together with a rivet seat 32 thereof tightly rivet the workpieces 4 together. With the oil pressure provided by the oil-pressure means 5, only a small effort is required to easily operate the hand blind riveter of the present invention to pull the blind rivet 3 held in the slidable blind rivet holder 1 and complete the otherwise effort-consuming riveting operation.

What is claimed is:

1. A hand blind riveter having a slidable blind rivet holder, a movable operating handle, and an oil-pressure means mounted between said slidable blind rivet holder and said movable operating handle wherein said oil-pressure means comprises: a housing located on the hand blind riveter and containing hydraulic fluid; a first piston slidably mounted in a first chamber in the housing having a first piston rod extending externally of the housing with an outer end connected to a working end of said operating handle such that movement of the operating handle causes movement of the first piston; a second piston slidably mounted in a second chamber in the housing having a second piston rod extending externally Of the housing with an outer end connected to said slidable blind rivet holder; first and second hydraulic fluid passageways, each connecting the first and second chambers, respectively; and, first and second check valves, one check valve located in each of the first and second hydraulic fluid passageways whereby when the movable operating handle is moved, said first piston is pushed inward to produce a pressure which is transmitted via hydraulic fluid through said first passageway and said first check valve to push said second piston outward, said outward moving second piston pulling said slidable blind rivet holder allowing a riveting action to be highly efficiently and effortless completed.

* * * * *